United States Patent [19]

Bates

[11] Patent Number: 4,802,655

[45] Date of Patent: Feb. 7, 1989

[54] APPARATUS FOR INJECTING SUBSTANCES INTO LIQUIDS

[75] Inventor: Kenneth W. Bates, Derbyshire, England

[73] Assignee: Injectall Limited, Sheffield, England

[21] Appl. No.: 158,274

[22] PCT Filed: Jun. 22, 1987

[86] PCT No.: PCT/GB87/00431

§ 371 Date: Feb. 15, 1988

§ 102(e) Date: Feb. 15, 1988

[87] PCT Pub. No.: WO88/00246

PCT Pub. Date: Jan. 14, 1988

[30] Foreign Application Priority Data

Jun. 25, 1986 [GB] United Kingdom ..... 8615481
Oct. 10, 1986 [GB] United Kingdom ..... 8624322

[51] Int. Cl.[4] ..... C21C 5/48

[52] U.S. Cl. ..... 266/218; 266/268; 266/270

[58] Field of Search ..... 266/47, 218, 226, 265, 266/266, 267, 268, 269, 270, 287

[56] References Cited

U.S. PATENT DOCUMENTS

| | | | |
|---|---|---|---|
| 3,495,815 | 2/1970 | Holmes | 266/270 |
| 4,298,192 | 11/1981 | Barbakadze et al. | 266/218 |
| 4,392,636 | 7/1983 | Clumpner | 266/218 |
| 4,575,393 | 3/1986 | Bates et al. | 75/53 |
| 4,742,995 | 5/1988 | Bates | 266/270 |

FOREIGN PATENT DOCUMENTS

| | | | |
|---|---|---|---|
| 0070799 | 1/1983 | European Pat. Off. . | |
| 289128 | 8/1969 | U.S.S.R. . | |
| 730817 | 5/1980 | U.S.S.R. | 266/226 |
| 1083600 | 9/1967 | United Kingdom . | |
| 1170559 | 11/1969 | United Kingdom . | |
| 2054396 | 2/1981 | United Kingdom . | |
| 2140142 | 11/1984 | United Kingdom . | |
| 2171186 | 8/1986 | United Kingdom . | |

*Primary Examiner*—L. Dewayne Rutledge
*Assistant Examiner*—Robert L. McDowell
*Attorney, Agent, or Firm*—Buchanan Ingersoll

[57] ABSTRACT

For injecting substances into a liquid e.g. molten metal, a nozzle block is mounted in the wall of a vessel containing the liquid. Initially, an injection passage extending through the block is closed by a plug to prevent ingress of liquid, and only when injection is to commence is the plug thrust aside by a delivery pipe movable in the passage, the pipe forming part of an injection lance assembly. The positions of the lance assembly before and after injection are determined by a safety stop arrangement for example comprising a detent in the form of a spring-loaded plunger housed in a fixed part of the apparatus; the plunger coacts with front and rear ramps of an abutment which is fast with part of the lance assembly, to govern the positions of the lance assembly before and after injection.

20 Claims, 5 Drawing Sheets

APPARATUS FOR INJECTING SUBSTANCES INTO LIQUIDS

The present invention concerns improvements in apparatus for injecting substances into liquids.

More particularly, the injection apparatus is primarily meant for injecting gases, gases plus powders, or solids—usually accompanied by gases, into potentially dangerous liquids, e.g. molten metals such as iron and steel. The purposes of injecting such substances are numerous and diverse. Our U.S. Pat. No. 4,575,393, outlines some of the reasons for introducing substances into molten metals and in this connection reference is directed to that publication for further details.

Like U.S. Pat. No., the present invention pertains to apparatus for injecting substances through a wall of a melt containment vessel such as a ladle. The wall could be the bottom or more usually the side of the vessel. The apparatus is of the type comprising a refractory block for installing in the vessel wall, the block being pierced by an injection passage in which a delivery pipe is movable forcibly towards a liquid-facing end thereof, to permit injection to commence by breaking or dislodging a passage blocking element which is temporarily located at or in this end to prevent melt entering the passage before injection is commenced. By expelling, breaking or dislodging the blocking element, the pipe opens the passage for admitting into the melt a substance delivered via the delivery pipe.

If the blocking element is prematurely or accidentally unseated from the end of the passage, melt could rapidly enter the passage due to the static pressure of the melt. Under some circumstances, the melt might leak from the vessel via the passage, e.g. thrusting the delivery pipe from the passage as it does so. This could obviously be dangerous. Alternatively, the melt might enter the passage and freeze therein, effectively sealing the passage and preventing the subsequent injection of substances into the melt. Unseating of the blocking element due to careless installation and/or premature advancement of the pipe is thus to be avoided and this invention aims to prevent such inadvertent advancement in a simple but effective manner.

According to one aspect of the present invention, there is provided apparatus of the type hereinbefore defined, for injecting substances into a liquid through the wall of a liquid containment vessel, wherein the delivery pipe is part of a lance assembly and wherein positioning means including a detent arrangement acting between said assembly and a fixed part of the apparatus define a stop for locating the lance assembly at a predetermined ready position prior to injection.

In a preferred embodiment, the stop defined by the detent arrangement locates a discharge end of the delivery pipe spaced from the passage blocking element a predetermined distance and prevents inadvertent displacement of the pipe into contact with the blocking element. The detent arrangement can be overcome when a predetermined advancing force is deliberately exerted on the lance assembly, said force being made greater than any force that could be applied manually.

The detent arrangement preferably also defines a second stop preventing inadvertent withdrawal or ejection of the lance assembly from an advanced, injection position thereof.

The detent arrangement can comprise a spring-loaded element on the one hand which coacts with an abutment on the other hand; the former may be housed in the fixed part of the apparatus when the latter is mounted on the lance assembly, or vice versa. Preferably two detents act on the lance assembly.

According to another aspect of the present invention, the stop enabling the lance assembly to be held in a predetermined position prior to injection comprises a shear pin and an abutment. The abutment shears off the shear pin allowing the lance assembly to be advanced to its injection position when a predetermined advancing force is deliberately exerted on the assembly. The force necessary to shear the pin is made greater than any force that can be applied manually.

Conveniently, the shear pin is mounted on the movable lance assembly and the abutment is on an immobile part of the apparatus. The stop functions, like the detent arrangement, to locate a discharge end of the delivery pipe spaced away from the blocking element until such time as the predetermined advancing force is applied.

As disclosed above the detent arrangement can also define a second stop preventing inadvertent displacement of the lance assembly from the advanced, injection position thereof. Accidental withdrawal of the assembly after injection has commenced, or its ejection due to the pressure of the liquid, could be highly dangerous since the high temperature liquid or melt could then escape from the vessel.

In the second embodiment of the present invention, the shear pin and abutment cannot also serve as a second stop for preventing withdrawal or ejection after initiating injection, because the shear pin is broken when the lance assembly is first moved to its injection position. A second stop can, desirably, be provided by another abutment on an immobile part of the apparatus and a companion abutment which is part of the lance assembly.

In one embodiment, the lance assembly can have a lance head member comprising a pair of orificed bodies, held together by a pivot bolt for one body to be swung relative to the other. Before and during injection, the bodies are so oriented that their orifices register to permit passage of an injectant. When an injectionis adjudged completed, the said one body was swung, upon the pivot bolt, relative to the other body causing its orifice to move out of registry with the orifice in the other body. Injection was thereby quickly stopped.

The design of another embodiment involves simplified machining operations and requires assembly of fewer component parts.

In this other embodiment, the lance head comprises but two parts, both orificed; one part is slidable in the other to shift its orifice out of conjunction with the orifice in the other part to terminate injection. When the slidable part is so shifted, the design is such that it projects from the other part, then serving as an abutment which coacts with an abutment on an immobile part of the apparatus to prevent a potentially dangerous withdrawal or ejection of the lance assembly. Such a structure is particularly simple to put into practice as will be appreciated from the following description.

In essence, a preferred lance head may comprise a cylinder pierced axially by an injectant passage. The cylinder acts as a union between the lance pipe and an injectant supply conduit. It is pierced transversely too, for closely accommodating an orificed plug. The plug can be shifted to terminate injection suddenly, and when shifted it coacts with the immobile abutment to serve as a check against withdrawal or ejection of the lance assembly.

A suitable ram is employed for displacing the pivotable or shiftable part of the lance head.

The invention comprehends methods of injecting substances into molten metal, which entail use of apparartus disclosed and claimed hereinafter.

The invention will now be described in more detail by way of example only with reference to the accompanying drawings of preferred embodiments thereof. In the drawings.

In the several drawings, like parts have the same reference numerals allocated thereto wherever possible.

Figure 1:
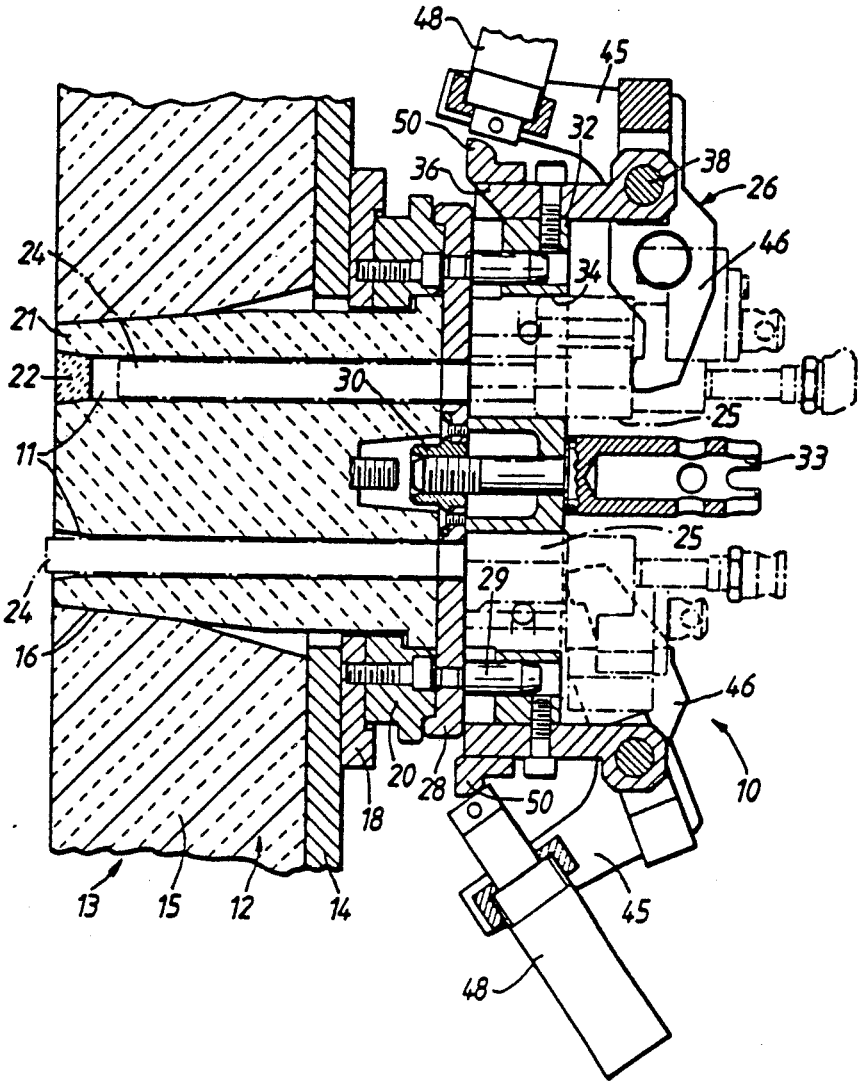
FIG. 1 is a general, partial cross-sectional view through the apparatus according to this invention, taken on line I—I of FIG. 2.
Figure 8:
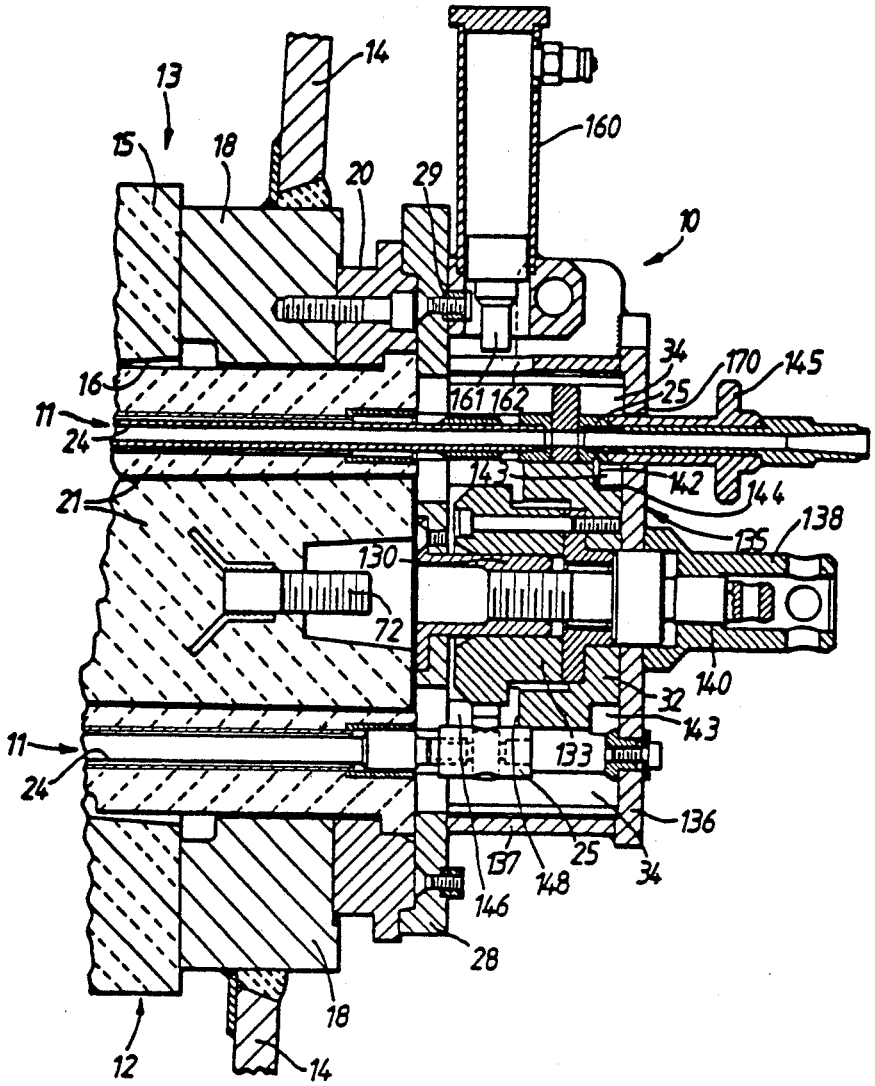
FIG. 8 is a general, partial cross-sectional view through another apparatus according to this invention.
Figure 9:
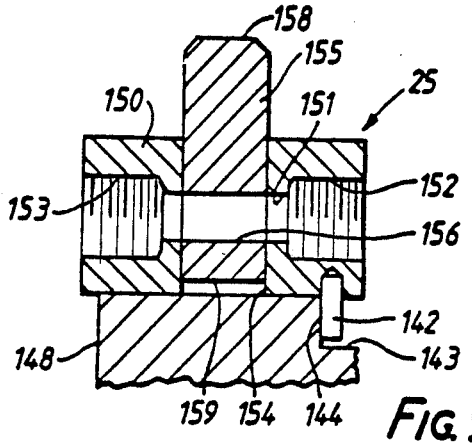
FIGS. 9 to 11 are cross-sectional views of a lance head attached to a delivery pipe installed in the apparatus of FIG. 8, showing also safety stops and their function during operation.

The apparatus 10 shown in FIGS. 1 and 8 of the accompanying drawings has a plurality of injection passages 11 for flexibility in use. With this apparatus different substances, and substances in different physical forms, can be injected simultaneously or in some chosen sequence into a high temperature liquid such as a molten metal. The illustrated apparatus may, for instance, have four passages 11. Apparatus according to the invention could have more or less than four passages : we have designed versions having eight and fifteen passages. Injection apparatus having but one injection passage is also within the scope of this invention.

The apparatus 10 can be used safely to introduce substances such as reagents into any liquid which is potentially dangersous, e.g. due to being at elevated temperature. It has, however, been particularly developed for use in metallurgical processes, more especially ferrous metallurgical processes, where the liquid is a molten metal or alloy. The melt temperature may be up to 1600° C. or higher, depending on the metal. The following description refers to melts for convenience, in view of the principal use for which the apparatus was developed.

Apparatus 10 is installed in the bottom or, more usually, the side wall 12 of a vessel 13 e.g. a ladle. The wall 12 comprises a metal shell 14 and an insulating inner lining 15. The apparatus 10 is located so as to inject substances deep into the melt contained in vessel 13, for instance at a level of 1 metre or more below the melt surface. The wall 12 is provided with a suitably-located injection opening 16 with which the apparatus 10 is registered. Around the opening 16, to the shell 14 an annular adaptor plate 18 is welded; the appratus 10 is fastened to the vessel by way of the adaptor plate 18.

An annular location plate 20 is bolted to the adaptor plate 18 for positioning a refractory block 21 properly in the opening 16. Block 21 is normally cemented in said opening to the lining 15. The refractory block in this embodiment is pierced by a plurality of injection passages 11 to form a plural-shot nozzle. There may, for instance, be four passages. Before injection commences, the passages 11 are closed at their inner, meltfacing ends by blocking elements (not shown in FIG. 8). The passage blocking elements 22 in FIG. 1 are shown located in the passages, but they could be cemented, across their passages, to the end face of the block 21. The blocking elements 22 are made of a suitable refractory material, and are so fitted to the block that they can be expelled or detached from their passages 11 when injection is to commence. If said elements are cemented across the discharge ends of the passages, either the cement chosen is one that provides a weak bond enabling the elements to be dislodged, or the elements are made of a frangible material.

A lance assembly is associated with each passage 11. The lance assemblies comprises delivery pipes 24 and inlet heads 25. The former are movable lengthwise in the passages 11 and the latter are disposed outwardly of the block 21. Means 26 (not shown in FIG. 8) are provided to advance the lance assemblies forcibly in the direction of the vessel interior, in order for the pipes 24 to dislodge or break the passage blocking elements 22 for commencing an injection. The said means 26 can be activated e.g. pneumatically or hydraulically. The pipes 24 are made of metal e.g. stainless steel, calorized steel or have a composite metal/refractory structure.

Figure 2:
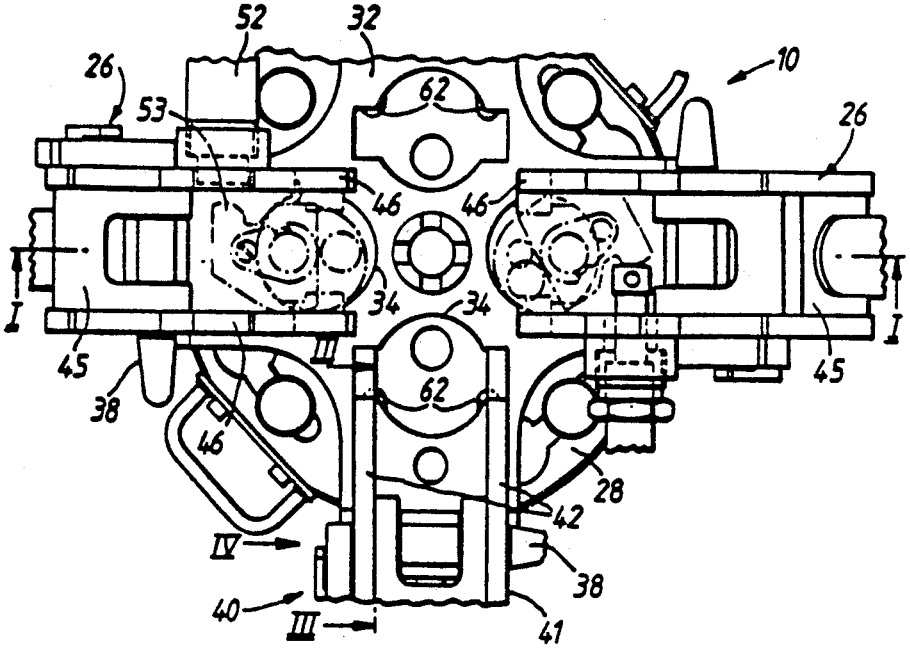
FIG. 2 is a partial end view of the apparatus shown in FIG. 1.

In FIG. 1, a circular cover plate 28 is detachably fastened to the location plate 20 such that openings in the cover plate register with associated ones of the injection passages 11. Plate 28 clamps nozzle block 21 in place in the opening 16. Location pins 29 and a central nut 30 are mounted on the cover plate 28. Said pins enter appropriatelypositioned receiving bores in a location block 32 which is assembled to the cover plate by a bolt 33 engaged with the nut 30. For the four-passage design shown in FIG. 1, the location block has a four-lobed shape and four apertures 34 arranged relative to the lobes as shown in FIG. 2. The apertures 34 of the mounted location block 32 suitably register with the passages 11 and the associated plate openings and are of larger diameter than the latter. In combination with the cover plate, the location block apertures 34 provide pockets into which the inlet heads 25 fit slidingly.

An advantageous and convenient feature of this invention resides in the design or construction of the parts employed for exerting proper control over the lance assemblies before, during ejection and upon stopping injection.

Figure 4:
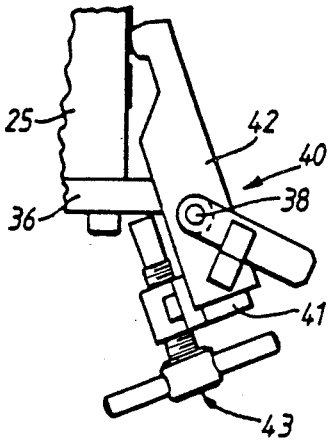
FIG. 4 is an elevational view of part of the apparatus as viewed in the direction of arrow IV in FIG. 2.

Secured to the location block 32, at the end of each lobe, is a mounting member 36 which has a bore for receiving a pivot pin 38. By means of the pivot pin, lance advancing means 26 or lance clmpas 40 are interchangeably and pivotally fastened to the location block 32. The lance clamps 40 are shown in FIG. 4. They are a convenient but not absolutely essential feature of the invention. Their purpose is to clamp the lance assemblies for safety in proper positions before and after injections. When an injection run is to be carried out, the clamps 40 are dismounted from the member 36 and advancing means 26 are substituted for them. The apparatus 10 can have two lance clamps 40 and two advancing means 26, whereby the apparatus can be ready to inject through two passages 11 simultaneously or in quick succession. If desired, there could be three clamps 40 and one advancing means 26. As stated, however, the clamps 40 can be omitted. Then, four advancing means 26, which incorporate hydraulic rams, can be used in their stead to clamp all the lance assemblies safely in their proper pre- and post-injection positions.

Figure 3:
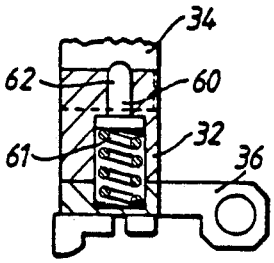
FIG. 3 is a part-sectional view on line III—III in FIG. 2.
Figure 6:
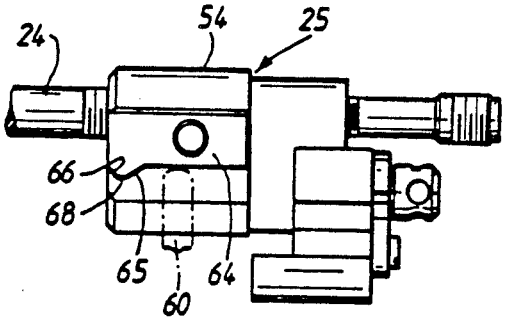
FIG. 6 is an elevational view of the lance head shown in FIG. 5.
Figure 7:
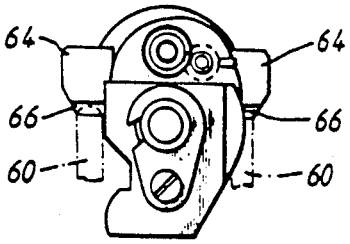
FIG. 7 is an end view of the lance head, looking towards the right hand end of the head as illustrated in FIG. 6.

As shown in FIGS. 2 and 4, each clamp 40 comprises a rigid fabrication or clamp body 41 having two arms 42 bearing against the lance inlet head and holding the latter in position. A manuallyadjustable thrust screw 43 is threaded to the clamp 40 and thrusts against the mounting member 36. Clearly, adjustments of the screw 43 effect pivoting of the clamp body 41 on the pivot pin 38 and thereby alter the position of the arms 42 bearing on the inlet head 25, so the clamp 40 can be set to hold the lance assembly in a chosen position. The chosen position before injection is determined by a stop to be described. Said stop is shown in FIGS. 3, 6 and 7. After injection the position can correspond to the lance location when its inlet head is bottomed in the pockets formed by apertures 34 in the location block 32.

The advancing means 26 also comprises a rigid fabrication or actuator body 45 having a pair of spaced arms 46 extending therefrom for bearing upon a lance inlet head 25. The body of an hydraulic actuator or ram 48 is fastened to the body 45 and has a piston advanceable into contact with an abutment 50 on the mounting member 36. When the ram is energised, the piston pushes against the abutment 50, urging the ram body away therefrom. Accordingly, the actuator body 45 is urged to pivot about the pivot pin 38 thrusting the arms 46 in the direction of the vessel wall. By suitably energising the ram 48, the arms 46 of the advancing means 26 can hold the lance assembly at the pre-injection position, can advance the assembly for dislodging the passage blocking means 22 to commence an injection, and can hold the lance assembly in the post-injection position.

The inlet heads 25 of FIGS. 1, and 5 to 7 are each constructed in two parts along the lines disclosed in our GB-A-2,171,186 and PCT/GB87/00117 to which attention is hereby directed. The outer one of the two parts is displaceable relative to the other part for rapidly terminating an injection. To effect the displacement, the same actuator body 45 of advancing means 26 mounts a second hydraulic ram 52 so that its piston can bear upon an abutment 53 fast with the outer part of the lance head.

Several benefits are obtained by forming a composite or unitary structure from the actuator body 45 and the two rams 48, 52 and by providing a single attachment (pivot 38) to the location block 32. After injection, the delivery pipes and the nozzle block 21 will routinely need replacing. The ready mounting and dismounting of the unitary structure eases such routine servicing by minimising disassembly. Moreover, it is easy to remove the unitary structure from one injection site of the apparatus, to locate it quickly at another injection site and to substitute a simple lance clamp for said structure. By this means, the need for each site to possess its own permanent actuation structure is avoided, saving cost and simplifying the overall installation.

Figure 5:
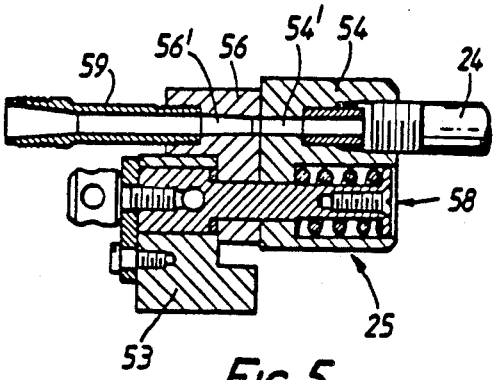
FIG. 5 is a cross-sectional view of a lance head attached to a delivery pipe installed in the apparatus of FIG. 1.

The lance inlet head 25 is shown more particularly in FIG. 5; its inner and outer parts 54, 56 meet at a plane inerface and are held securely together by a combination of a draw bolt and a spring 58. Each part is pierced by a passage 54', 56' and the two passages are aligned before and during injection. The aligned passages convey injection substances, i.e. gas, gas and powder or wire from a supply conduit 59 to the delivery pipe 24. The abutment 53 secured to the outer part 56, detachably for a purpose which need not be explained here, is engaged by the piston of ram 52 when it is desired to terminate injection. On activating ram 52, the abutment 53 is displaced and with it outer head part 56. The latter rotates relative to the head part 54 on the draw bolt, which serves as a pivot. Head part 54 cannot rotate in view of its seating in the aforementioned pocket provided by the aperture 34 in the location block 32. The relative rotation of part 56 moves passage 56' out of registry with the companion passage 54' and hence closes the route from the supply of the injection substance(s) to the delivery pipe 24. Where the lance assembly is used for conveying aninjection substance in the form of a wire strand, the parts 54, 56 will include shear bushes operative at the plane interface to sever the strand upon activation of ram 52.

A particular inventive feature of this development is the stop mentioned hereinbefore. The stop is shown in FIGS. 3, 6 and 7 to which reference is now made. In essence, the stop is a detent operative between the or each lance assembly and some suitable fixed part of the apparatus 10. For each lance assembly, the detent in its simplest form comprises a spring-loaded plunger and an abutment, one affixed to the lance and the other to the fixed part of the apparatus. As shown, the spring-loaded plunger 60 is located in a housing 61 formed jointly by the location block 32 and the mounting member 36 (the fixed part of the apparatus). The housing 61 is positioned adjacent a respective aperture 34 in the locting block 32 and a bore extends from the housing to the aperture. A shank 62 of the plunger 60 extends through the bore. A spring in the housing 61 acts upon an enlarged head of the plunger 60 to urge the stem 62 into the aperture 34. The tip of stem 62 coacts with an abutment affixed to the lance head 25, and more particularly to the inner head part 54, when the lance head is located in the aperture 34. The abutment 64 has inclined front and rear faces or ramps 66, 65 engageable by the plunger 60. The plunger 60 and front ramp 66 define a stop which determines the position of the lance assembly before injection commences. In this position, the delivery pipe 24 is set back from the passage blocking element 22. By correct design and choice of spring, it is made impossible for anyone manually to displace the lance assembly forwardly past the stop. For example, a force of some ½ ton (508 kg) may be needed to advance the assembly past the stop, i.e. to cause ramp 66 past the detent plunger. Thus, inadvertent dislodging of the blocking element 22 through careless handling or installation is prevented.

The advancing means 26 is, however, well capable of developing the force needed to move the lance assembly and overcome said stop. When so moved, the ramp 66 displaces the plunger 60 inwardly relative to the housing 61 against the spring bias, and a point is reached where the tip of the plunger is on a dwell face 68 of the abutment 64. During continued movement of the lance assembly by advancing means 26, the passage blocking element is dislodged so injection can commence. Ultimately, the lance assembly reaches a fully advanced position when the plunger 60 and rear face 65 of the abutment coact to define a second stop and prevent manual retraction of the lance assembly from its injection position. The second stop also prevents rearward ejection of the lance assembly by the pressure of the melt.

When all the injections have been carried out, the delivery pipes 24 are firmly welded in their forward positions into their respective passages 11 by metal that has frozen in the spaced between the delivery pipes and the passages.

With the lance heads 26 in their forward positions, the rear ramp faces 65 have passed to the front of plungers 60. It is then possible to remove the location block 32 after unscrewing bolt 33 without interference, and the lance heads 25 can be unscrewed from the delivery pipes 24. By means of appropriate tooling affixed to the delivery pipes 24, they and the refractory nozzle block 21 can be extracted for replacement.

A particular advantage of the illustrated detent is its ability to assist in cleanly dislodging the blocking element 22 from the end of the injection passage 11. When the lance assembly is moved forwards to commence dislodging the blocking element 22, a point is reached where the rear ramp 65 approaches the plunger 60. When the latter contacts the rear ramp 65, the spring biasing on the plunger 60 has the effect of suddenly thrusting the abutment 64 forwards and with it the lance assembly; the sudden forward movement caused by the camming effect of the spring-loaded plunger on the rear ramp 65 results in the delivery pipe suddenly ejecting the blocking element 22.

As described, there can be but one detent acting between the or each lance assembly and the fixed part of the apparatus. For preference, however there are two detents acting in concert. Thus, fitted on each lance assembly there are two diametricallyopposed abutments 64 and two spring-loaded plungers 60 are therefore housed in the location block 32.

Conceivably, the abutment could be made part of the fixed location block and the spring-loaded plungers could be carried by or incorporated in the lance assemblies, but for design purposes it is preferred that they are arranged as described and illustrated.

The apparatus 10 shown in FIG. 8 has been described in part already, in conjunction with FIG. 1 above. The principal differences embodied in the FIG. 8 arrangement will now be described, followed by a description of the lance head arrangement designed for use with this apparatus.

In the apparatus 10 of FIG. 8, a circular mounting plate 28 is detachably fastened by means not shown to the location plate 20, such that openings in the mounting plate register with the injection passages 11. Plate 28 again clamps the nozzle block 21 in place in the opening 16. A central nut or boss 130 which is internally screw threaded is mounted on the plate 28, and location block 32 is assembled to the mounting plate with a collar portion 133 of block 32 telescoped over the boss 130. The location block has a plural lobed shape having as many lobes as there are passages 11 and lance assemblies, the lobes suitably registering with the passages 11 and the openings in the mounting plate 28. Recesses 134 in the periphery of the location block 32 provide pockets in which the inlet heads 25 fit and are capable of moving slidably.

A cover 135 consisting of a circular plate 136 and skirt 137 is fastened to the apparatus 10 by a nut 138 which engages a central screw threaded spindle 140 which is screwed into the boss 130. The spindle 140 has an enlarged portion to engage the locating block 32 and clamp the latter to the mounting plate when the spindle is screwed into the boss 130.

An advantageous and convenient aspect of this invention resides in the provision of and design or construction of the parts employed for exerting proper control over the positioning of the lance assembly before, during injection and upon stopping injection.

As with the first described embodiment, means is provided to render the lance assemblies of the embodiment of FIGS. 8 to 11 captive in the apparatus before injection, and means is provided to render them captive after commencing an injection.

For rendering the lance assemblies captive before injection, each is provided with an abutment element that coacts with fixed abutments on immovable parts of the apparatus 10. The lance abutment element is a shear pin 142 fastened to and projecting from a head member 25 of the lance. The shear pin is received in a slot 143 in the location block 32. The pin extends radially inwards, towards the central fastening means 130, 138 and 140, and the slot 143 is radially outwardly open to accept the pin. The slot 143 ends in an abutment face 144. The shear pin 142 and abutment face 144 on immovable location block 32 check premature movement of the lance assembly towards the interior of the vessel 13 and the passage blocking element, not shown. They locate a discharge end of the lance delivery pipe set back a predetermined distance from the passage blocking element. To advance a lance assembly so as to break or dislodge the associated passage blocking means, the assembly has to be thrust forward with sufficient force to snap the shear pin 142. The force, which is substantial, is greater than can practically be exerted manually on the lance assembly. The force is exerted through a pneumatic or hydraulic actuator, now shown, which acts on a thrust-/coupling member 145 connected between the lance head 25 and a conduit leading to a supply of injectant. The actuator can be similar or equivalent to advancing means 36, 48 of the first described embodiment.

The shear pin 142 also coacts with an inner face of the cover plate 136, preventing withdrawal of the lance assembly after installing it in the apparatus 10 and before an injection is commenced.

The lance assembly seen at the top of FIG. 8 is in the pre-injection position, the shear pin 142 being in the slot 143 in contact with the lance locating abutment face 144.

The locating block 32 further defines a second slot 146 located closer to the mounting plate 28 than slot 143. Slot 146 also opens radially outwardly, and at its end further from plate 28, the slot terminates in a second abutment face 148. Abutment face 148 coacts with an abutment of or on the lance head 25 to prevent withdrawal or ejection of the lance assembly after injection.

The lance head 25 is a particularly simple fabrication. It is in two parts. The first part 150 comprises a cylindrical metal bar pierced axially by a passage 151 for conveying injectant from a supply conduit to the delivery pipe 24. The passage is counterbored at opposite ends of head part 150, and the counterbores 152, 153 are screw threaded for attaching the supply conduit and delivery pipe 24 respectively to the head part 150. The shear pin 142, which may be a small brass rod, is fastened in a radial bore provided therefor in the head part 150.

The head part 150 is also pierced by a transverse bore 154 that intersects passage 151. A second cylindrical part 155 of the head 25 tightly but movably fits in the transverse bore 154. The second head part 155 is traversed by a passageway 156. Before and during injection, the head parts 150, 155 are so disposed that passage 151 and passageway 156 are in registry for injectant to flow to the delivery pipe. In this position, one end 158 of head part 155 projects radially from the head part 150; the opposite end 159 does not project, however.

Incidentally, after injection has commenced, the projecting end 158 can coact with the cover plate 136 to render the lance assembly captive to the apparatus 10. In the unlikely event of failure of a hydraulic or pneumatic actuator acting on thrust member 145, the pressure of the melt can push the lance assembly outwardly only a short distance, until movement of the assembly is checked by the head part 155 striking plate 136.

Injection is stopped by shifting the head part 155 in bore 154 of the first head part 150, moving passageway 156 wholly out of registry with passage 151. To shift the head part 155, a hydraulic or pneumatic ram 160 mounted on the cover 135 is activated. Ram 160 has a push rod 161 positioned generally in line with the end 158 of head part 155 when the lance assembly is in its forward, or injection, position. The push rod 161 has access to the end 158 through a slot 162 in the skirt 137 of the cover. The ram 160 displaces head part 155 causing end 159 thereof to project radially from head part 150. This movement of head part 155 is arrested by a stop surface 164 provided on the collar 133 of the locating block 32.

Upon closing off the flow of injectant by ram 160, melt enters and freezes in the discharge pipe 24, blocking it. The pressure of the melt may urge the lance assembly outwards. Outward movement is safely limited, however, by the projecting end 159 of head part 155 moving into abutment with abutment face 148 on the immobile location block 32.

The lance assembly shown above the centreline in FIG. 1 is in a pre-injection or ready position, when the lance head is shown—enlarged—in FIG. 2. The effect of the shear pin 142 and abutment face 144 in properly locating the lance head 25 and hence the lance assembly can be readily discerned from FIG. 9.

Figure 10:
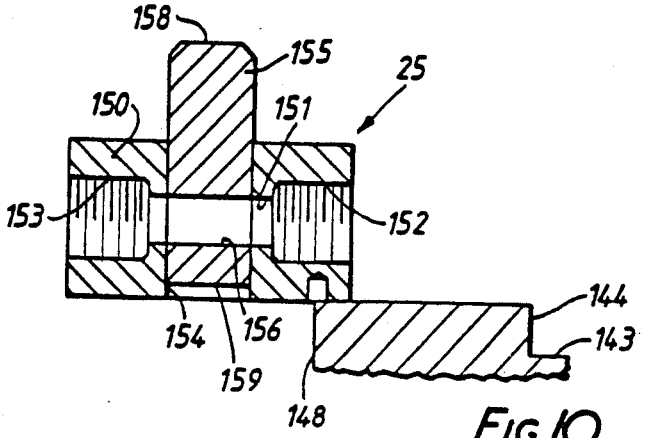

For initiating injection, the lance assembly is forcibly advanced leftwards, in the direction of the vessel interior, snapping the shear pin 142 against abutment 144 and unblocking the passage 11. FIG. 10 shows the lance head position relative to the abutments 144, 148 after the lance assembly has been advanced to the injection position.

Figure 11:
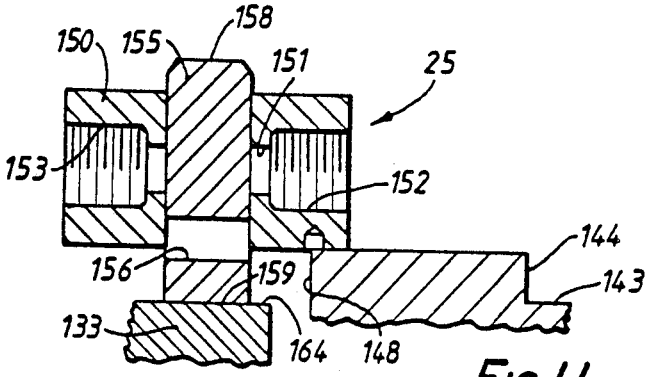

FIG. 11 shows the lance head still in the advanced position, after the head part 155 has been displaced to terminate injection. Ejection or withdrawal of the lance assembly in a rightward or outward direction will now be prevented by the obstacle presented by abutment 148 to the projecting end 159 of head part 155.

With a plural passage injection device according to this embodiment of the invention, the several lance assemblies are installed in the lobed location block 32 with the cover 135 dismounted from the apparatus 10. The assemblies are restricted to the pre-injection position by the stop means 142, 144. The cover 135 is then fitted.

The cover 135 may be arranged such that but one lance assembly can be advanced and used at a time for injection. To this end, the plate 136 has a single aperture 170 giving access to a selected lance assembly. The thrust/coupling member 145 is passed through this aperture 170 and abuts lance head 25, and an actuator is engaged with the member 145 for advancing the lance assembly when required. The actuator 160 is secured at a fixed location to the cover 135 corresponding to the selected lance assembly. After injection via this assembly, the member 145 is disconnected therefrom and the nut 138 released sufficiently to enable the cover 135 to be rotated. The actuators may be disengaged from the used assembly or removed, as necessary to free the cover 135 for rotation. The cover 135 is then rotated until its aperture 170 is aligned with another selected, unused lance assembly where-upon the cover is locked in position by nut 138. The member 145 is then fitted and the lance advancing actuator (not shown) is suitably engaged therewith.

When all the lance assemblies have been used, the cover 135 is dismounted and the male threaded spindle 140 is unscrewed from the female threaded boss 130. The location block 32 can then be dismounted and the heads of used lance assemblies can be unscrewed for re-use.

The nozzle block 21 is removable from the opening 16, for example for replacement after detaching the mounting plate 28. If, as often will happen, the lance pipes become welded or frozen into the block 21, the latter can be removed by pulling on the lance assemblies. Should the lance pipes pull from the block 21 leaving the latter still in the opening 16, then the block can be removed by a suitable puller which is attached to a threaded anchor 72 cast or mouded into the block.

As a practical matter and with the user's convenience in mind, it is contemplated that in most cases the nozzle block will be scrapped and replaced by a new block every time all the lance assemblies have been used, so that neither the block nor the lance pipes will be reused.

It should be appreciated that the foregoing description is illustrative only and that various changes may be made within the scope of the appended claims.

INDUSTRIAL APPLICABILITY

The invention is applicable for introducing substances to aggressive liquids and melts which are at high temperatures, such as molten metals. Thus, the invention can, for instance, be used in ferrous metallurgy for introducing gaseous, solid or particulate materials into molten steel or iron, for various purposes. Thus, using the invention one can introduce alloying elements, especially readily volatizable elements such as aluminium and potentially hazardous, volatilizable elements such as lead. Substances used for grain refinement or for controlling carbide formation can be introduced similarly. Likewise, the invention can be used to introduce substances used e.g. to desulphurise, desiliconise or dephosphorise the melt.

I claim:

1. Apparatus for installation in the wall of a liquid containment vessel for injecting substances into a liquid therein, including a refractory block which is pierced by an injection passage, has in injectant delivery pipe therein and has a passage blocking element temporarily located at or in a delivery end of the passage to prevent liquid entering the passage before injection is commenced, the pipe being movable forcibly in the passage at the said element to break or dislodge said element to open the passage for injection, wherein the delivery pipe is part of a lance assembly and wherein positioning means acting between the said assembly and a fixed part of the apparatus define a stop for locating the lance assembly at a ready position prior to injection.

2. Apparatus according to claim 1, wherein the positioning serves to locate a discharge end of the delivery pipe spaced away from said passage blocking element and to prevent inadvertent displacement of the pipe into contact with the blocking element.

3. A lance assembly for use in the apparatus claimed in claim 1, comprising a delivery pipe having an inlet head attached to one end for coupling the pipe to an injectant supply, and the inlet head includes (i) a first member fixed to said delivery pipe and being pierced by a through passage for conveying injectant to the pipe, and (ii) a second member which has a through passage aligned with said first member through passage when injectant is being delivered through said inlet head to said delivery pipe, said second member being pivotable relative to said first member about a pivot axis parallel to said through passages so that said second member through passage may be moved.

4. A lance assembly for use in the apparatus claimed in claim 1, comprising a delivery pipe having an inlet head attached to one end for coupling the pipe to an injectant supply, and the inlet head includes (i) a first member pierced by a through passage for conveying injectant to the pipe and by a through bore intersecting the passage, and (ii) a second member which is located in the bore, the second member comprising an apertured plug displaceable along the bore from a first position, wherein its aperture aligns with the passage for flow of injectant through the inlet head, to a second position wherein the aperture is out of registry with the passage and the plug blocks the passage to injectant flow, the second member projecting laterally from the first member in its flow-blocking position.

5. Apparatus for installation in the wall of a liquid containment vessel for injecting substances into a liquid therein, including a refractory block which is pierced by an injection passage, has an injectant delivery pipe therein and has a passage blocking element temporarily located at or in a delivery end of the passage to prevent liquid entering the passage before injection is commenced, the pipe being movable forcibly in the passage at the said element to break or dislodge said element to open the passage for injection, wherein the delivery pipe is part of a lance assembly and wherein positioning means including a detent arrangement acting between the said assembly and a fixed part of the apparatus define a stop for locating the lance assembly at a ready position prior to injection.

6. Apparatus according to claim 5, wherein the positioning serves to locate a discharge end of the delivery pipe spaced away from said passage blocking element to prevent inadvertent displacement of the pipe into contact with the blocking element.

7. Apparatus according to claim 5, wherein the detent arrangement defines a second stop preventing inadvertent withdrawal of the lance assembly from an advanced, injection position thereof.

8. Apparatus according to claim 5, wherein the detent assembly comprises a spring-loaded element which coacts with an abutment.

9. Apparatus for installation in the wall of a liquid containment vessel for injecting substances into a liquid therein, including a refractory block which is pierced by an injection passage, has an injectant delivery pipe therein and has a passage blocking element temporarily located at or in a delivery end of the passage to prevent liquid entering the passage before injection is commenced, the pipe being movable forcibly in the passage at the said element to break or dislodge said element to open the passage for injection, wherein the delivery pipe is part of a lance assembly and wherein positioning means including a detent arrangement acting between the said assembly and a fixed part of the apparatus define a stop for locating the lance assembly at a ready position prior to injection, said detent arrangement comprising a spring-loaded element which coacts with an abutment, said abutment having two inclined faces or ramps with which the spring-loaded element coacts to define two stops, the first stop enabling the lance assembly to be held at said ready position and the second stop preventing withdrawal of the lance assembly from an advanced, injection position.

10. Apparatus according to claim 9, wherein the spring-loaded element is mounted in a fixed part of the apparatus and the abutment is mounted on the lance assembly.

11. Apparatus according to claim 9, wherein said fixed part is a location block which has an aperture providing a pocket therein, an inlet head of the lance assembly is slidable in said pocket between said ready position and an advanced, injection position, and a spring-loaded element forming part of the detent arrangement is housed in the location block adjacent the aperture, an abutment also forming part of the detent arrangement is mounted on the inlet head, and said spring-loaded element and abutment coact to provide the lance locating stop.

12. Apparatus according to claim 13, wherein the lance assembly has an inlet head comprising conjoined outer and inner members having aligned bores providing a through passage for conveying injection substance(s) into the delivery pipe, the outer member being pivoted to the inner member and displaceable relative thereto for misaligning the bores to terminate supply of said substance(s) into the pipe when an injection run is to be stopped, an hydraulic ram being provided for displacing the outer member relative to the inner member, and wherein the hydraulic ram is mounted on the said advancing means.

13. Apparatus according to claim 11, further including means to advance the lance assembly from the pre-injection position to the advanced, injection position, the advancing means being detachably connected to the location block and including an hydraulic ram operatively coupled to the inlet head for thrusting the latter past the said stop.

14. Apparatus according to claim 13, wherein the advancing means is a unitary structure comprising a body bearing on the inlet head and pivoted detachably to the location block, the body mounting the ram which, by thrusting against an abutment on the location block, causes a pivotal displacement of the body in a direction for advancing the lance assembly to the injection position.

15. Apparatus for installation in the wall of a liquid containment vessel for injecting substances into a liquid therein, including a refractory block which is pierced by an injection passage, has an injectant delivery pipe therein and has a passage blocking element temporarily located at or in a delivery end of the passage to prevent liquid entering the passage before injection is commenced, the pipe being movable forcibly in the passage at the said element to break or dislodge said element to open the passage for injection, wherein the delivery pipe is part of a lance assembly and wherein positioning means acting between the said assembly and a fixed part of the apparatus define a stop for locating the lance assembly at a ready position prior to injection, said positioning means comprising coacting abutments on the fixed parts and the lance assembly, one of the abutments being a shear pin which is fast with the lance assembly.

16. Apparatus according to claim 15, wherein the shear pin is severable permitting advance of the lance assembly to an injection position, force needed to shear the pin being greater than any force that can be exerted manually on the lance assembly.

17. Apparatus according to claim 15, further including means to prevent withdrawal or ejection of the lance assembly after injection, the preventing means including a stop defined by a second abutment on the fixed part and a coacting second abutment of or on the lance assembly.

18. Apparatus according to claim 17, wherein the lance assembly comprises a lance head having a lance head member movable therein to close an injectant passage through the lance head, the said member when moved to close the passage then projecting from the lance head to a position enabling it to serve as the second abutment which coacts with the second abutment on the said fixed part.

19. Apparatus for injecting substances into a liquid through a wall of a liquid containment vessel, including a refractory block which is pierced by an injection passage, has an injectant delivery pipe therein and has a passage blocking element temporarily located at or in a delivery end of the passage to prevent liquid entering the passage before injection is commenced, the pipe being movable forcibly in the passage at the said element to break or dislodge same to open the passage for injection, wherein the delivery pipe is part of a lance assembly and wherein a stop means is provided to prevent withdrawal or ejection of the lance assembly after an injection has been completed, the stop means comprising respective abutments on the lance assembly and a fixed part of the apparatus.

20. Apparatus according to claim 19, wherein the lance assembly includes a lance head having a movable member and an injectant passage closeable by the movable member which, to close the passage, projects from the lance head for coaction with an abutment on the said fixed part.

* * * * *

UNITED STATES PATENT AND TRADEMARK OFFICE

CERTIFICATE OF CORRECTION

PATENT NO. : 4,802,655

DATED : February 7, 1989

INVENTOR(S) : KENNETH W. BATES

It is certified that error appears in the above-identified patent and that said Letters Patent is hereby corrected as shown below:

Column 1, line 8, change "solid-" to --solids--.

Column 1, line 9, delete "s".

Column 1, line 16, change "No.," to --No. 4,575,393,--.

Column 4, line 42, change "appropriatelypositioned" to --appropriately-positioned--.

Column 5, line 14, change "manuallyadjustable" to --manually-adjustable--.

Column 6, line 19, change "aninjection" to --an injection--.

Column 7, line 10, change "26" to --25--.

Column 7, line 35, change "diametricallyopposed" to --diametrically-opposed--.

UNITED STATES PATENT AND TRADEMARK OFFICE

CERTIFICATE OF CORRECTION

PATENT NO. : 4,802,655

DATED : February 7, 1989

INVENTOR(S) : Kenneth W. Bates

It is certified that error appears in the above-identified patent and that said Letters Patent is hereby corrected as shown below:

Column 11, line 51, Claim 6, after "element" insert --and--.

Signed and Sealed this

Nineteenth Day of December, 1989

*Attest:*

JEFFREY M. SAMUELS

*Attesting Officer*

*Acting Commissioner of Patents and Trademarks*